US005692866A

United States Patent [19]

Hefty

[11] Patent Number: 5,692,866

[45] Date of Patent: Dec. 2, 1997

[54] BOOKBINDING METHOD AND APPARATUS

[76] Inventor: John B. Hefty, 1232 Paula Cir., Gulf Breeze, Fla. 32561

[21] Appl. No.: 502,386

[22] Filed: Jul. 14, 1995

[51] Int. Cl.[6] ..... B42B 5/00

[52] U.S. Cl. ..... 412/6; 412/4; 412/21; 412/34; 281/21.1; 281/29

[58] Field of Search ..... 281/21.1, 29, 15.1, 281/23; 412/8, 901, 37, 4, 19, 20, 900, 33, 21, 34, 1, 5, 6; 156/908

[56] References Cited

U.S. PATENT DOCUMENTS

| | | | |
|---|---|---|---|
| 411,100 | 2/1889 | Domroe et al. | 281/21.1 |
| 3,284,102 | 11/1966 | Sack | 281/21.1 |
| 3,749,422 | 7/1973 | Abildgaard et al. | 281/29 X |
| 3,749,423 | 7/1973 | Abildgaard et al. | 281/29 X |
| 4,091,487 | 5/1978 | Axelrod | 281/21.1 |
| 4,139,216 | 2/1979 | Saint Clair | 281/34 X |
| 4,706,994 | 11/1987 | Lockhart | 281/29 |
| 4,986,713 | 1/1991 | Zoltner et al. | 281/21.1 X |
| 5,061,139 | 10/1991 | Zoltner | 281/21.1 X |
| 5,066,182 | 11/1991 | Stonebraker et al. | 281/21.1 X |
| 5,314,283 | 5/1994 | Zoltner | 412/900 X |
| 5,330,229 | 7/1994 | Zoltner | 281/15.1 |

*Primary Examiner*—Frances Han

*Attorney, Agent, or Firm*—George A. Bode; Michael L. Hoelter; Bode & Associates

[57] ABSTRACT

A method and apparatus for binding books wherein a stack of pages are collated and aligned together. This stack is covered, top and bottom, with end pages which now comprise the first and last pages of the stack. Each end page includes a self-adhesive or sticky-back surface that is temporarily covered with a protective sheet. This stack is inserted within a clasp that is subsequently crimped, thereby securely binding the stack together. The crimped stack is then placed within an outer case or covering whereupon the protective sheet is removed and adhesive is exposed and applied to the case in order to secure or bind the pages to the case. Final compression of the case insures proper adhesion.

17 Claims, 5 Drawing Sheets

BOOKBINDING METHOD AND APPARATUS

BACKGROUND OF THE INVENTION

1. Field of the Invention

This invention pertains to the art of bookbinding and more particularly, to a new method and apparatus for manually binding papers, such as those that have been individually customized or made to order, into a hardbound book.

2. General Background

The art of bookbinding is an old art, the origins of which stretch back many years to antiquity. Before the creation of printing presses, Medieval monks stitched hand-lettered parchment leaves together and covered them with a binding, oftentimes made of leather. Such techniques were handed down from master to apprentice, and even today, some of these techniques remain virtually unchanged.

The basic skills necessary to bind books are relatively easy to master and this art can also be practiced in confined areas with commonly available tools and materials. However, despite these advantages, bookbinding is undertaken by only a small number of professionals, artists, and/or hobbyists.

Generally, the books that are currently available today will often be bound in one of three ways. First, most hardcover books and other high quality paperbacks will be "signature bound." This method combines various groups of pages (each such group being called a "signature") that are sewn to each other until the entire content of the book has been assembled. Each signature is derived from a single large sheet of paper that has been folded and refolded several times before being sewn together and trimmed to provide either 16, 32, or 64 individual and consecutive pages. Books that have been signature bound can generally be detected by inspecting the top or bottom of the pages next to the spine for evidence of such signatures. If there is doubt about such construction, the book can always be spread open for a search for the thread which binds each individual signature together. Signature bound books are the most durable since it is nearly impossible for a page to work itself loose from the binding.

Second, to supply the mass market, small sized paperbacks are often "perfect bound." The designation "perfect" relates not to the quality of the binding, but instead to the method by which all four sides of a signature (including the folds of the signature) are trimmed to the desired paper size. These loose pages are then glued directly to the spine of the case or covering. There are no threads holding these pages together, thus it is not uncommon for one or more pages to become detached from the spine and come out of the book.

Third, most magazines and books having relatively few pages are "saddle stitch bound" (or "saddle wired"). This technique, which formerly utilized thread, uses wire staples to secure one or more "signatures" together. These signatures are first trimmed to size and then are nested inside one another. Afterwards, staples are driven through the entire stack, including the cover, and the pages are folded around the line of staples. Such staples can be detected on the spine of such books or magazines between the two innermost pages. Of course, this method of bookbinding is the least secure since it is quite common for defects to arise while stapling. Oftentimes, one or more staples will be missing or such staples will not effectively hold the "signature" together, thereby allowing the book or magazine to come undone.

It is an object of the present invention to provide a new method and apparatus for bookbinding that is quick and easy to use.

It is also an object of this invention to provide a means of securely holding the pages of a book together such that they cannot come loose under normal use.

A further object of this invention is to provide a manner of bookbinding that can be utilized by the individual artist or hobbyist to bind books without requiring a multitude of specialty equipment or a high level of skill.

Yet another object of this invention is to provide a bookbinding method that does not require large amounts of manpower, machinery, or materials, thereby reducing the cost of and time required for each such binding.

Another object of this invention is to provide a manner of bookbinding that can be utilized to bind any number of books, from one up to a large number, however many as is desired.

Yet another object of this invention is to provide a means whereby customized or specialty books may be bound in a quick and inexpensive manner and without fear of providing inadequate binding.

Still another object of this invention is to enable such binding to occur without the need for glues or long set-ups which prolong the bookbinding operation. These and other objects and advantages of this invention will become apparent upon further investigation.

SUMMARY OF THE PRESENT INVENTION

The preferred embodiment of the method and apparatus of the present invention solves the aforementioned problems in a straightforward and simple manner. This invention pertains to a method and apparatus for bookbinding that consists of initially collating and aligning a plurality of pages together into a stack with this stack having a spine side thereof. A pair of end pages or end papers are inserted on the top and bottom of the stack (these end pages comprising the first and last pages of the stack) with each end page incorporating one outwardly facing surface with an adhesive that is covered by a protective coating. Afterwards, a clasp is inserted around the spine side of the stack which is then crimped in order to permanently secure the pages and the end pages of the stack together. The now crimped stack is then positioned and aligned with respect to an outer case. This outer case consists of a spine region and a pair of oppositely spaced covers pivotally connected to this spine region. Upon proper alignment, the protective coating of one end page is removed, thereby exposing its adhesive surface which is then affixed to its respective, mating cover of the case. Subsequently, the adhesive surface of the opposite end page is exposed and affixed to its respective mating cover. Afterwards, the end pages are compressed against their respective covers to permanently bond them to the covers.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
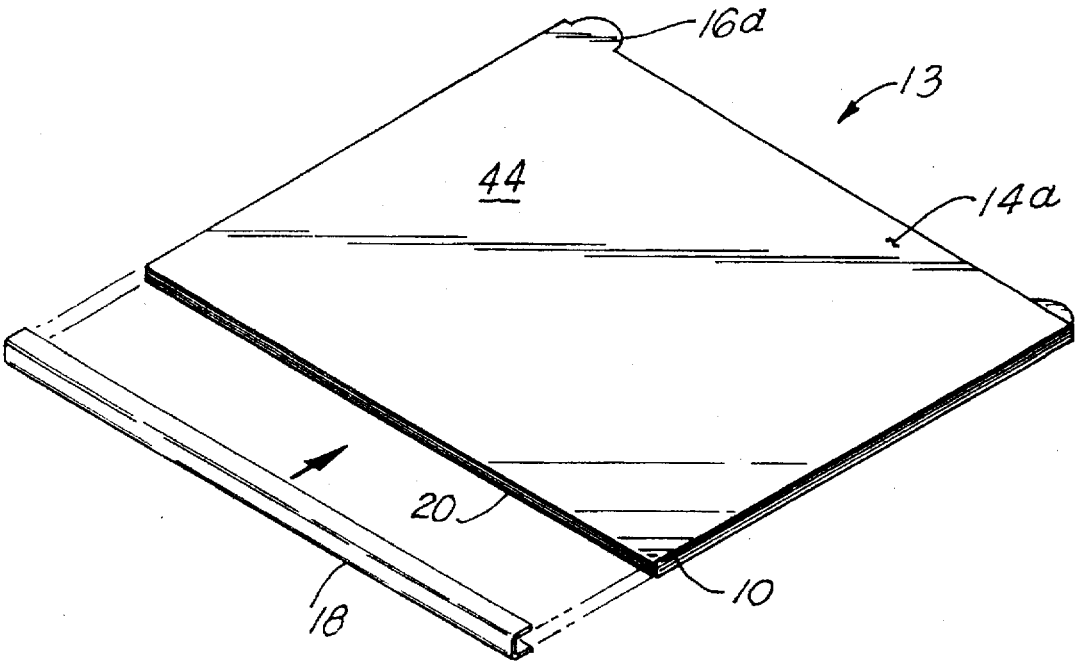
FIG. 1 is a pictorial view of the stack of the collated pages of the book (without cover) and the clasp which will be clamped to these pages.

Referring initially to FIG. 1, there is shown a collection or stack 13 of loose pages 10 which will eventually comprise the contents of book 12. Of course, before assembly of book 12, this stack 13 of pages 10 would be properly collated and aligned. Additionally end papers or end pages 14 would be placed top and bottom on this stack so as to comprise the first 14a and last 14b pages thereof. Ideally, the exposed or outer surface or side of each end paper 14 would contain a press-on adhesive (sticky-backing) that is temporarily covered by a protective coating such that upon removal of the coating, the adhesive is exposed. In this embodiment, tabs 16*a*, 16*b* are illustrated which aid in the removal of this protective coating from its respective end paper 14*a*, 14*b*.

Prior to the insertion of the spine side or marginal edge 20 of stack 13 of pages 10 within clasp 18, these pages 10 would all be properly aligned with each other. Any necessary trimming or collating of these pages 10 would be completed prior to the spine side 20 being inserted within clasp 18. Clasp 18, in this embodiment, is generally a metal U-shaped channel that extends fully along one side, side or marginal edge 20, of pages 10. Side 20 is designated the spine side of these pages 10. Clasp 18 is ideally constructed of thin metal so that it may be bent, deformed, or crimped so as to clamp pages 10 together; however, if desired, clasp 18 may be constructed of other material so long as it is capable of securely holding pages 10 together. While this embodiment discloses clasp 18 as being the same length as spine side 20 of pages 10, clasp 18 may also be shorter in length if such is desired.

Once pages 10 are inserted within clasp 18, this combination is seated within slot 22 of a conventional crimping machine 24 (one such machine is SAFETY-BIND made by Channel Bind, Inc.). Upon proper placement therein, handle 26 is pivoted as indicated by ARROW A to consequently crimp clasp 18. Generally, handle 26 is pivoted a number of times to insure proper crimping has occurred. While in this embodiment machine 24 is illustrated, the actual operation of such machine is of limited importance to the invention so long as clasp 18 is crimped to hold pages 10 together. In fact, such crimping may be accomplished manually (by a tool such as pliers or VISE-GRIPS) or automatically depending on the needs of the user. Additionally, such crimping may be continuous along spine side 20 of pages 10 or such crimping may be intermittent or spaced along such side 20. In any event, the important point of this invention being that clasp 18 is made to permanently bind pages 10 together, no matter how such a binding operation is accomplished.

Figure 2:
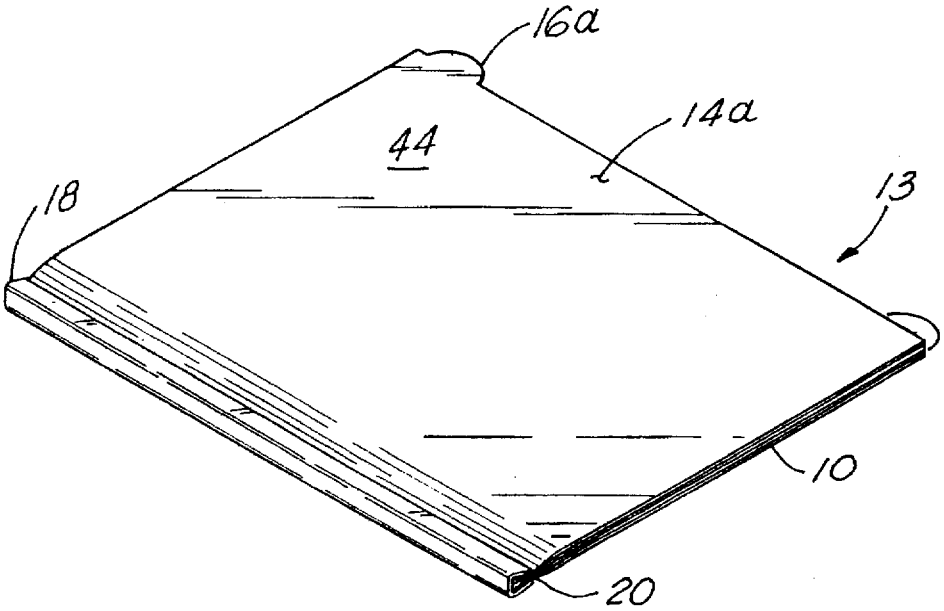
FIG. 2 is a pictorial view of the stack of the collated pages of the book (without cover) of FIG. 1 after being clamped together by the clasp.
Figures 3, 4:
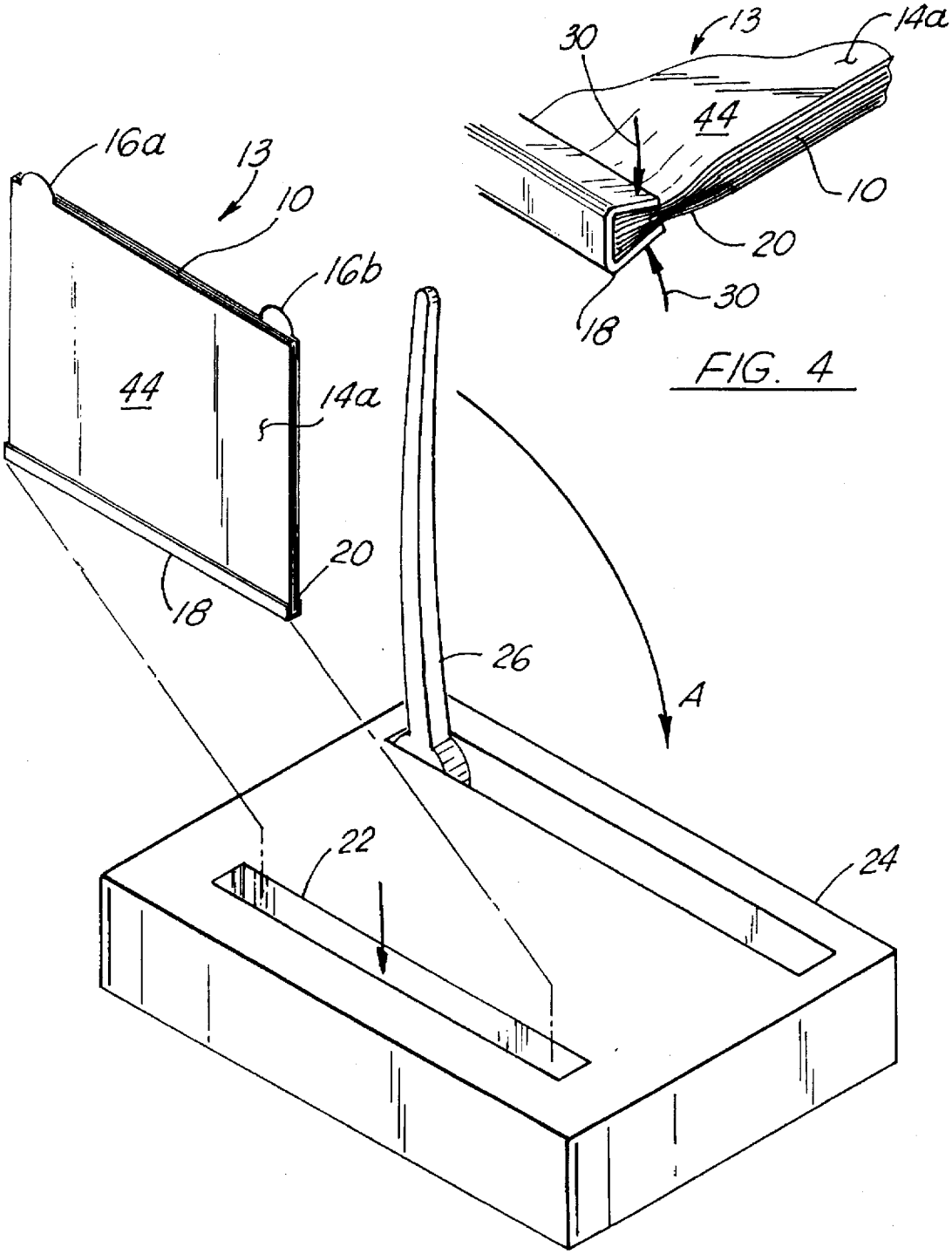
FIG. 3 is a pictorial view illustration of the apparatus used to clamp the pages together as was shown in FIG. 2.
FIG. 4 is a pictorial view, partially cut away, illustrating in greater detail how the pages of the book (without cover) of FIG. 2 are clamped or crimped together.

After this crimping step is completed, stack 13 of pages 10, which are now clamped or crimped together via clasp 18, are removed from machine 24. Stack 13 of pages 10 and clasp 18 should now appear as shown in FIGS. 2 and 4 such that pages 10 are now permanently bound or pressed together as indicated by the set of ARROWS 30 of FIG. 4. In this manner, no individual page 10 is capable of coming loose or falling out of stack 13 because a permanent bond now holds pages 10 together. It is at this stage that any portion of clasp 18 that extends beyond pages 10 can be trimmed if need be. Also, any last trimming of pages 10 can also occur since no further movement or sliding of one page with respect to another (other than being turned or pivoted about spine side 20) is now possible.

Figure 5:
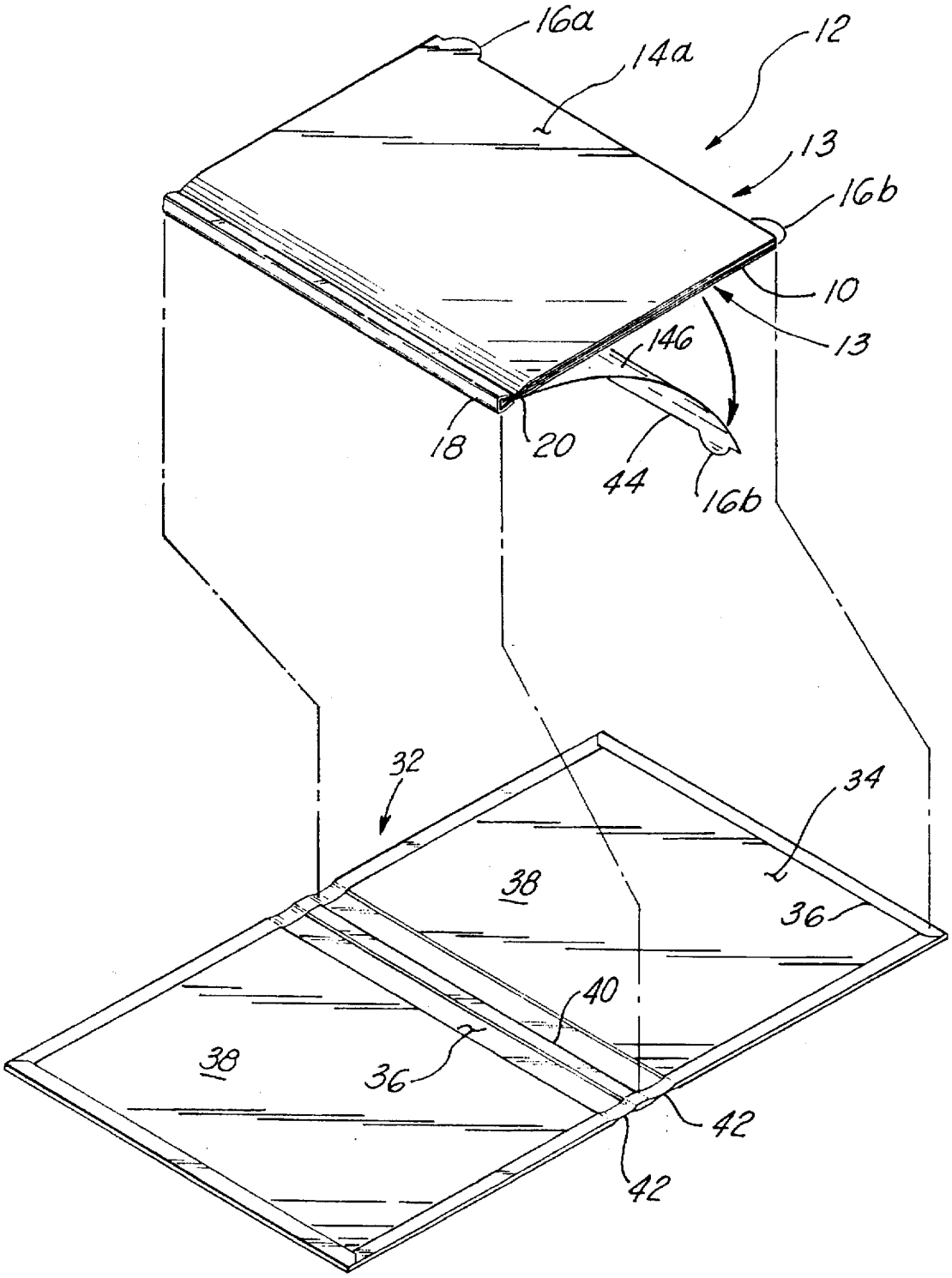
FIG. 5 is a pictorial view illustrating how the clamped pages of FIG. 2 are inserted within a book cover or case.

In accordance with this invention, the next step is to insert these bound pages within cover or case 32 as best shown in FIG. 5. Case 32 generally consists of cardboard, thick stock or other generally rigid material 34 that is usually thicker than pages 10. This case 32 is oftentimes covered or wrapped by leather, plastic, paper or fabric 36 which is folded around the edges of cardboard 34 as shown. Also, covering 36 may be decorated with a design or an illustration as desired to make book 12 more attractive. Covering 36 can also be utilized to make book 12 more durable. In any event, case 32 generally consists of two hinged covers 38 with the integral region between them including pivot line or spine 40. As shown in this embodiment, each hinge 42 of case 32 consists of the material used for covering 36, thus again the desire for such covering to be durable. However, in other embodiments, covers 38 and spine 40 may all be of a single piece of cardboard or stock 34 without any separate covering 36 applied thereto. Thus the integral flexible area between each cover 38 and spine 40 will be hinge 42. The actual configuration of book 12 and case 32 is dependent upon the manufacturer.

Figure 6:
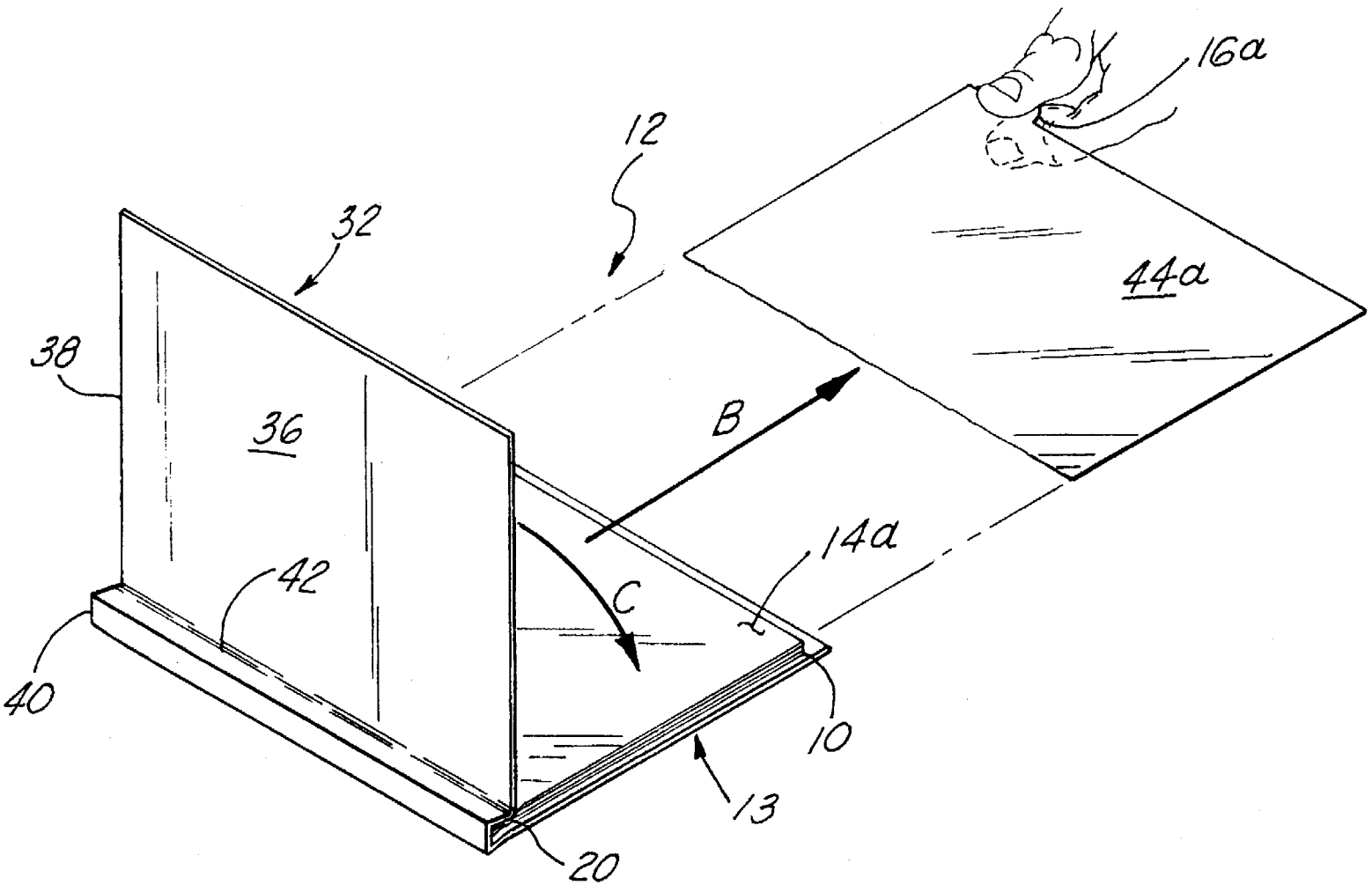
FIG. 6 is a pictorial view illustrating how the pages of the book of FIG. 5 are secured within the book cover or case.
Figure 7:
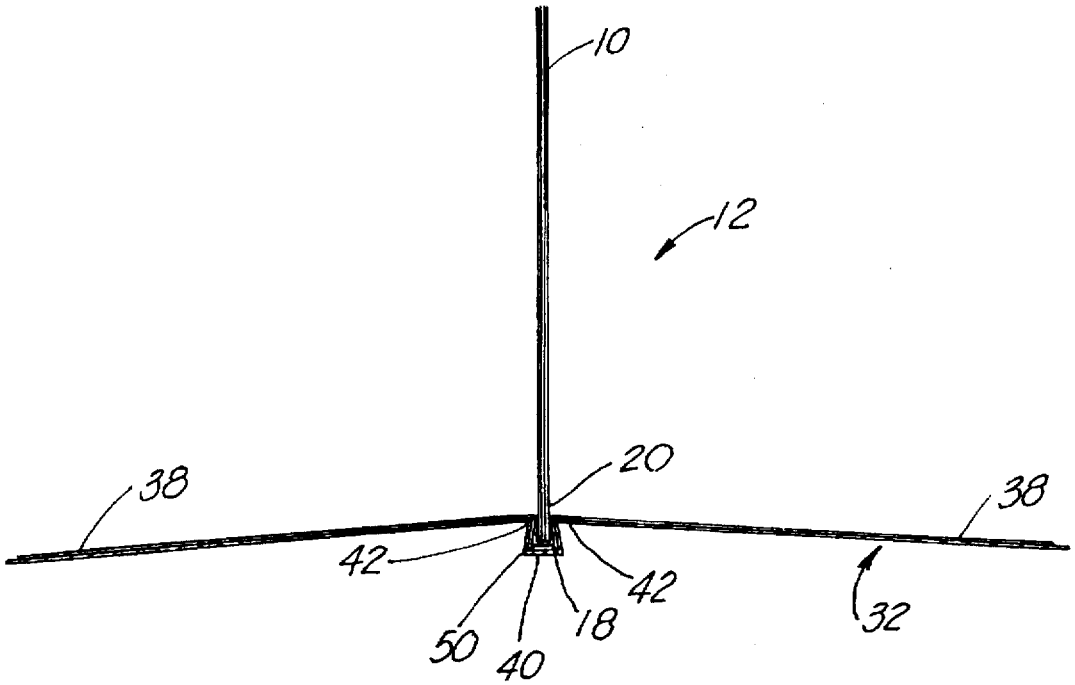
FIG. 7 is an end pictorial view of the bound book of the apparatus of the present invention (in the open position) after assembly; and, FIG. 8 is a pictorial view of the bound book of FIG. 7 (in the closed position) after assembly.
Figure 8:
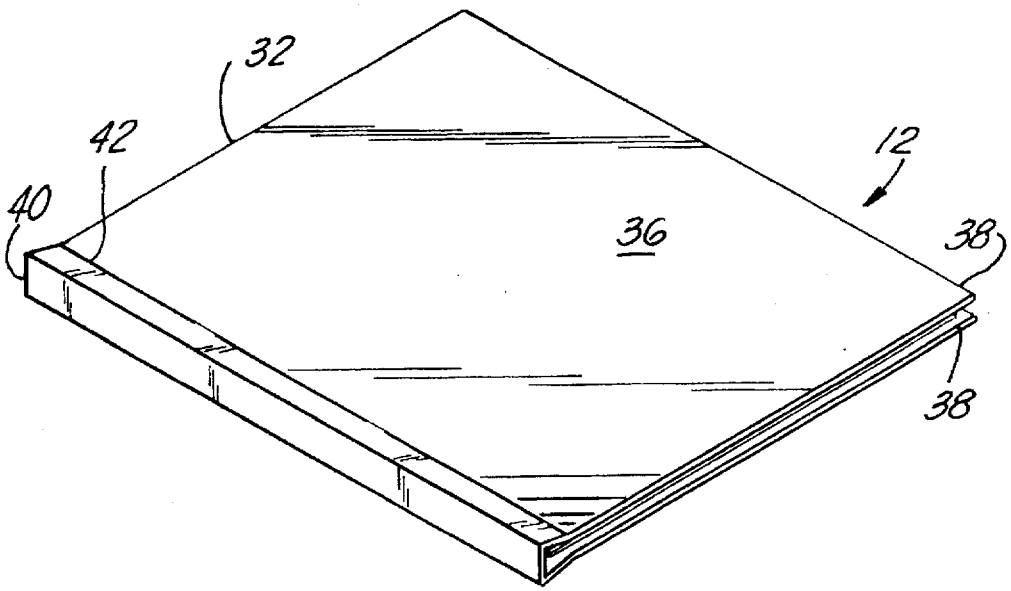

Referring now to FIG. 6, there is shown the step of removing the protective coating 44 of each end paper 14, such as by grasping its tab 16 and peeling coating 44 off. Upon the removal of protective coating 44 (as indicated by ARROW B), the self-sticking adhesive underneath such coating 44 (on the outwardly facing surface of end pages 14) is exposed. This adhesive side of each of pages 14 will then be pressed against its respective mating cover 38 to secure stack 13 of pages 10 to case 32. Once the protective coating 44 from each end paper 14 is removed such that their respective adhesive sides are glued to their respective mating covers 38, the construction of book 12 will have been completed as best seen in FIGS. 7 and 8. Ideally, the adhesive side or surface of each end paper 14 will be sized to also cover a portion of the inside surface of covering 36, thereby blocking the folded-over edges of covering 36 from view. Protective coating 44 may now be disposed of in the proper manner. It would also be wise to close both covers 38 (and hence book 12) and apply additional pressure to the outside of book 12 in order to further compress the inside surface of each cover 38 against its respective mating sticky-backed end paper 14 to further cause the adhesion between the two to take effect. This is shown by ARROW C in FIG. 6.

FIGS. 7 and 8 illustrate book 12 in both its open (FIG. 7) and closed (FIG. 8) position. As indicated in FIG. 7 and from the above description of the assembly of book 12, there will be a small gap 50 between clasp 18 (holding stack 13 of pages 10 together) and spine 40 of case 32. Thus, the two may move with respect to each other as book 12 is used and/or stored. In the above manner of construction, there is no need to secure clasp 18 to spine 40 of case 32 since end papers 14 serve this function. This gap 50 also permits the use of headbanding (not shown) as applied to case 32 which provides additional strength at the point where book 12 is most likely to be grasped and pulled from a shelf. Such headbanding can also serve the purpose of strengthening hinges 42.

From the above, it will thus be seen that the steps in assembling book 12 consist of the following:

1. Assemble and collate individual pages 10 (presuming that they have already been trimmed to the proper size) and place an end paper 14 top and bottom over such pages (protective coating 44 facing out) to create stack 13.
2. Insert pages 10 and end papers 14 within clasp 18 (FIG. 1). Check for proper alignment.
3. Place assembly in crimping machine 24 to crimp clasp 18 (FIG. 3). Insure that clasp 18 has been properly deformed along its length in order to securely hold pages 10 and end pages 14 together (FIGS. 2 and 4).
4. Align crimped clasp 18 on spine 40 of case 32 (FIG. 5). Insure that pages 10 and end papers 14 are in alignment with covers 38.
5. Remove protective coating 44 from the outer surface of each end paper 14, thereby exposing the adhesive and press this adhesive surface or side of each end paper 14 against its respective cover 38 (FIG. 6).
6. Check the final assembly of book 12 by fully opening covers 38 to insure that clasp 18 is not stuck or secured to spine 40 (FIG. 7).
7. Close book 12 and further press covers 38 together to strengthen the adhesive bond between one surface of end papers 14 and the inside of each cover 38 (FIG. 8).

As a result of the above steps and by utilizing the indicated apparatus, the binding of books of any size or configuration is now possible. There are no special skills required for this and thus the art of bookbinding becomes readily available to nearly any interested individual. This method of bookbinding can easily be accomplished by small businesses who may desire to produce individualized or customized books for their customers. Also, to aid in such customization, the pages of any book 12 can be computer generated with such pages then being permanently bound by the above method.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A method of bookbinding comprising the steps of:

(a) collating and aligning a plurality of pages together into a stack, said stack having a spine side along one marginal side edge thereof;

(b) adding end pages to the top and bottom of said stack, said end pages now being the first and last pages of said stack with each of said end pages having one of its outer surface comprising an adhesive surface covered by a protective sheet;

(c) inserting said spine side of said stack into clasp means;

(d) crimping said clasp means onto said stack, thereby fixedly securing said pages and said end pages of said stack together;

(e) positioning and aligning said crimped stack with respect to an outer casing, said outer casing comprising a spine region and a pair of oppositely spaced covers pivotally connected to said spine region;

(f) removing said protective sheet of one said end page, thereby exposing said adhesive and affixing said exposed adhesive surface to one of said covers of said case;

(g) removing said protective sheet of the opposite of said end pages, thereby exposing its adhesive surface and affixing this said adhesive surface to the other of said covers of said case;

(h) providing a gap between said clasp and said spine region of said outer case such that said clasp is not affixed to said spine region but instead is movable with respect thereto; and, (i) compressing said end pages against said covers to bond said adhesive surfaces to said covers.

2. A bookbinding apparatus comprising:

(a) a stack of collated and aligned pages, said stack having a spine side along one marginal side edge thereof;

(b) end pages positioned on the top and bottom of said stack, said end pages now being the first and last pages of said stack with each of said end pages having one adhesive surface covered by a protective sheet;

(c) a clasp inserted around said spine side of said stack, said clasp being formed to be crimped onto said stack to permanently secure said pages and said end pages of said stack together;

(d) an outer case positioned and aligned with respect to said secured stack, said outer case comprising a spine region and a pair of oppositely spaced covers pivotally connected to said spine region, said adhesive surface of a first end page being exposed and affixed to a corresponding surface of one of said covers of said case, and, said adhesive surface of the opposite of said end pages being exposed and affixed to a corresponding surface of the other of said covers of said case; and, (e) a gap provided between said clasp and said spine region of said outer case, such that said clasp is not affixed to said spine region but instead is movable with respect thereto.

3. The apparatus as set forth in claim 2, further comprising at least one tab secured to said protective sheet of each of said end pages to aid in the removal thereof from said end page.

4. The apparatus as set forth in claim 2, wherein said clasp is an open U-shaped channel and wherein the length of said clasp is sized equal to or less than the length of said spine side of said stack.

5. The apparatus as set forth in claim 2, wherein said pages are trimmed to size prior to the collation and alignment thereof.

6. The apparatus as set forth in claim 2, further comprising means for protectively wrapping said outer case, and especially said spine region and said pair of oppositely spaced covers pivotally connected thereto.

7. The apparatus as set forth in claim 6, wherein said clasp continuously or intermittently crimps said spine side of said stack.

8. The apparatus as set forth in claim 2, wherein said outer case is constructed of pieces of stock thicker and more rigid than said pages.

9. A method of bookbinding comprising the steps of:

(a) collating and aligning a plurality of pages together into a stack, said stack having a spine side along one marginal side edge thereof;

(b) adding end pages to the top and bottom of said stack, said end pages now Being the first and last pages of said stack with each of said end pages having one adhesive surface covered by a protective sheet;

(c) inserting said spine side of said stack into clasp means;

(d) crimping said clasp means onto said stack, thereby fixedly securing said pages and said end pages of said stack together;

(e) positioning and aligning said crimped stack with respect to an outer casing, said outer casing comprising a spine region and a pair of oppositely spaced covers pivotally connected to said spine region;

(f) removing said protective sheet of one said end page, thereby exposing said adhesive and affixing said exposed adhesive surface to one of said covers of said case;

(g) removing said protective sheet of the opposite of said end pages, thereby exposing its adhesive surface and affixing this said adhesive surface to the other of said covers of said case; and, (h) providing a gap between said clasp and said spine region of said outer case such that said clasp is not affixed to said spine region but instead is movable with respect thereto.

10. The method as set forth in claim 9, further comprising the step of compressing said end pages against said covers to bond said adhesive surfaces to said covers.

11. The method as set forth in claim 9, further comprising the step of providing at least one tab on said protective sheet of each said end page to aid in the removal thereof from said end page.

12. The method as set forth in claim 9, further comprising the step of covering said outer case, and especially said spine region and said pair of oppositely spaced covers pivotally connected thereto, with a wrapping for protection thereof.

13. The method as set forth in claim 9, further comprising the step of constructing said outer case of stock that is thicker and more rigid than said pages.

14. The method as set forth in claim 13, further comprising the step of continuously crimping said clasp against said spine side of said stack.

15. The method as set forth in claim 13, further comprising the step of intermittently crimping said clasp against said spine side of said stack.

16. The method as set forth in claim 11, further comprising the step of providing said clasp as an open U-shaped channel, the length of said clasp being sized equal to or less than the length of said spine side of said stack.

17. The method as set forth in claim 16, further comprising the step of trimming said pages to size prior to the step of collation and alignment thereof.

* * * * *